US007038695B2

(12) United States Patent
Lin et al.

(10) Patent No.: US 7,038,695 B2
(45) Date of Patent: May 2, 2006

(54) USER INTERFACE DISPLAY APPARATUS USING TEXTURE MAPPING METHOD

(75) Inventors: Hung-Yi Lin, Hsinchu (TW); Kun-Nan Cheng, Hsinchu (TW)

(73) Assignee: MStar Semiconductor, Inc., (TW)

( * ) Notice: Subject to any disclaimer, the term of this patent is extended or adjusted under 35 U.S.C. 154(b) by 15 days.

(21) Appl. No.: 10/812,173

(22) Filed: Mar. 30, 2004

(65) Prior Publication Data

US 2005/0219255 A1 Oct. 6, 2005

(51) Int. Cl.
*G09G 5/00* (2006.01)

(52) U.S. Cl. ..... 345/582; 345/589; 345/592; 345/597; 345/606; 345/601; 345/629

(58) Field of Classification Search ..... 345/582, 345/589, 592, 597, 606, 601, 629
See application file for complete search history.

(56) References Cited

U.S. PATENT DOCUMENTS 4,808,988 A * 2/1989 Burke et al. ..... 345/16
5,917,504 A * 6/1999 Yutaka et al. ..... 345/533
5,920,303 A * 7/1999 Baker et al. ..... 345/172
6,011,564 A * 1/2000 Furuhashi et al. ..... 345/501
6,097,402 A * 8/2000 Case et al. ..... 345/543
6,392,643 B1 * 5/2002 Furuhashi et al. ..... 345/419
2002/0008703 A1 * 1/2002 Merrill et al. ..... 345/473

* cited by examiner

*Primary Examiner*—Matthew C. Bella
*Assistant Examiner*—Mike Rahmjoo
(74) *Attorney, Agent, or Firm*—Michael Bednarek; Pillsbury Winthrop Shaw Pittman LLP

(57) ABSTRACT

A low cost user interface display system, like on screen display (OSD), using texture mapping method is presented. The present invention only uses a little texture memory and can generate very fancy user interface display. With the method of texture mapping, even the low cost system can have a colorful, fancy user interface display. A user interface display apparatus using texture-mapping method, comprising a image module, texture patterns, display code-buffer, texture mixer and outline shape index generator to texture-maps the predefined image module in the mixing area with the texture patterns. For some existing OSD devices, the texture-mapping method also can provide a low cost approach to fancy the original OSD display output in the display device. Moreover, changing the texture pattern is very easy to system manufacture, and it can make the user interface looks good and different.

9 Claims, 12 Drawing Sheets

USER INTERFACE DISPLAY APPARATUS USING TEXTURE MAPPING METHOD

BACKGROUND OF THE INVENTION (A) Field of the Invention

The present invention generally relates to a user interface display apparatus. More particular, the invention relates to a low cost user interface (UI) display apparatus, like on screen display (OSD) in TV, video player, projector, monitor, or display panel of telephone, consumer household appliances, electronic dictionary, calculator, electronic caption, clock, bulletin board, or pager. OSD means a display function which shows the message on screen for user to select or change some functions of application system. Normally it is overlap on the display window.

(B) Description of the Related Art

In the art, a display system with a low cost user interface (UI) display apparatus means a display system without powerful Central Processing Unit (CPU) and Operation System (OS) for display function, and just display the message for user to select or change which built-in function in device will be used, like used OSD in TV, computer monitor, video player, or display panel of telephone, consumer household appliances, electronic dictionary, calculator, or simply display the message for user to watch, like used in a electronic caption, clock, watch, bulletin board, and pager.

The UI display in these systems is not the major function, but just provides an interface for user to adjust some functions of the system. The CPU in these systems is just fit for the major function, and no extra power for fancy display. So the UI display is usually as simple as possible and the cost of UI display apparatus is lower than the major display function device.

Nowadays, the color display device like LCD will be widely used to replace many kinds of display device, but the UI display function is still simple. Compared to the powerful display ability of computer with GUI (graphic user interface) like Microsoft Windows, the UI of low cost display devices are still with a very simple form. For example, the OSD function on PC's monitor is simple, and with limited color compared to the PC versatile window operation system. That's due to the OSD function is performed in the monitor side but not in the PC side.

Two methods were provided to perform the OSD function for UI display in the prior art.

FIG. 1 shows UI display using a character base method. This method divides the UI display range to pieces of characters, each character 102 is predefined. A display code-buffer is used to arrange the character for display and store the character index of character set 103 for display window. For example, if a UI display window with size 128×60 dots, and each character 102 is 16×12 dots, thus the UI display window can be divided into 8×5 characters, and the size of display code-buffer 100 is 8×5×CW ("CW" is the code index width). Dmn 101 means at the matrix location (m,n) where is the display code-buffer 100 store the code for addressing the content in character set 102. A character set 103 with 256 character counts will have 8 bits CW ($2^8$=256). By the way, each character 102 color depth (D) also could be defined, typically, as 1 bit, 2 bits, 3 bits, or 4 bits. 1 bit means 2 colors, 2 bits means 4 colors and so on.

In this case, the required space of a memory to store a character 102 is 16×12×D. The memory cost will depend on quantity of character font, character size, and color depth D. For some display patterns need the same text, like character "A", we can use the same character font by setting the code-buffer index to reduce the memory usage. That's the main advantage of character base UI.

FIG. 2 shows the UI using bitmap method. Bitmap method is a simple way to display all kinds of needed patterns. By predefined all kinds of patterns stored in memory bank 201, the display choose which pattern is need for current UI display 202. The pattern 200 is the one of the image stored in the memory bank 201 and will be displayed next time on UI display 202. The memory usage is huge since all patterns during user operation must be prepared and hard to be reuse. It does not take the advantage of character base method, so one pattern may need the size equal to one UI display range. The memory storage requirement is typically P times the display window sizes. P is the pattern counts of UI function, and the display window sizes depends on H×V×D, H is the horizontal size, V is the vertical size, and D is the color depth per dot.

Above two methods still limited to the memory cost, and make the fancy UI hard to implement. The present invention can make the UI display much fancy with a little texture memory added. It is the simplest way for UI designer to design a fancy UI display, and make it easy to accept by end-user. Using texture mapping method can be very easy to fancy character base UI display by only adding a little texture memory. The total memory required for one character set is 16×12×D×(number of character font), where the character size is set as 16×12 dots and D colors.

SUMMARY OF THE INVENTION

The primary objective of the present invention is to provide a user interface display apparatus to perform on screen display function, which is using the texture mapping method.

The secondary objective of the present invention is to provide a user interface display apparatus, which can provide colorful display image and user definable image.

The third object of the present invention is to provide a low cost user interface display apparatus.

In order to achieve the above-mentioned objectives and avoid the problems of the prior art, the present invention provides a user interface display apparatus, refer to FIG. 3, which comprises an image module 301, texture pattern 302, display code-buffer 303, and texture mixer 304. An image module 301 is dealing with the predefined image pattern, the predefined image pattern could be bitmap image, font image or small as 1 dot pixel. The dimension of image pattern can be different. It is the basic display element for UI display window, and can be character, icon, object or sub-window. The image module 301 accepts the code index from the display code-buffer 303, and uses the index to generate the image module content, then the module pixel is sent to the texture mixer 304. A texture pattern 302 is a predefined image to fill the mixed area. It accepts the texture index from the display code-buffer 300 and generates the content of texture. Then the texture pixel is sent to texture mixer 304 for mixing. A display code-buffer 303 is used to arrange the image module 301 pasted on the UI display window. It generates the code index for module 301, texture index for texture 302 patterns. A texture mixer 304 is used for mixing the pixel from image module 301 and texture pattern 302.

The user interface display apparatus of the present invention further comprises an outline shape index generator 305, it generates the mixing area information for texture mixer 304. The mixing area information defines the outline shape of display from image module 301 and can be defined by several different ways, like alpha index of modules, color key method, sub-window define method, and pixel index of texture pattern.

Compared with the prior art, the present invention uses the texture mapping method to provide fancy effects of on screen display and only increase a limited cost. Consequently, the present invention is a low cost and easy way for system maker to design a fancy, colorful and user-friendly interface for end-user to operate the system. It is easy to change the content of user interface display by change some texture patterns and even the user can download their favor image or photo to replace the texture patterns made by system makers. Also, the present invention can coexist with the existing OSD devices, with texture-mapping method, even the most monotonous OSD form can change to a fancy, colorful and user-friendly one.

BRIEF DESCRIPTION OF THE DRAWINGS

Other objectives and advantages of the present invention will become apparent upon reading the following description and upon reference to the accompanying drawings in which.

DETAILED DESCRIPTION OF THE INVENTION

Figure 1:
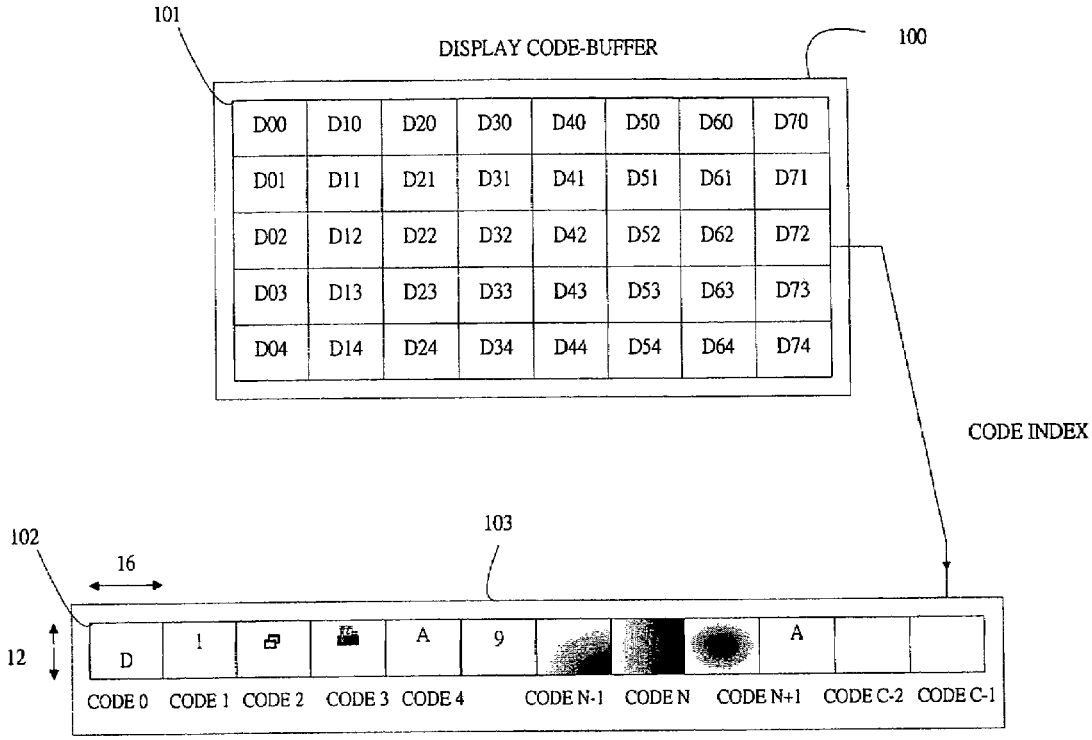
FIG. 1 is an example diagram showing the character base method according to the prior art.
Figure 2:
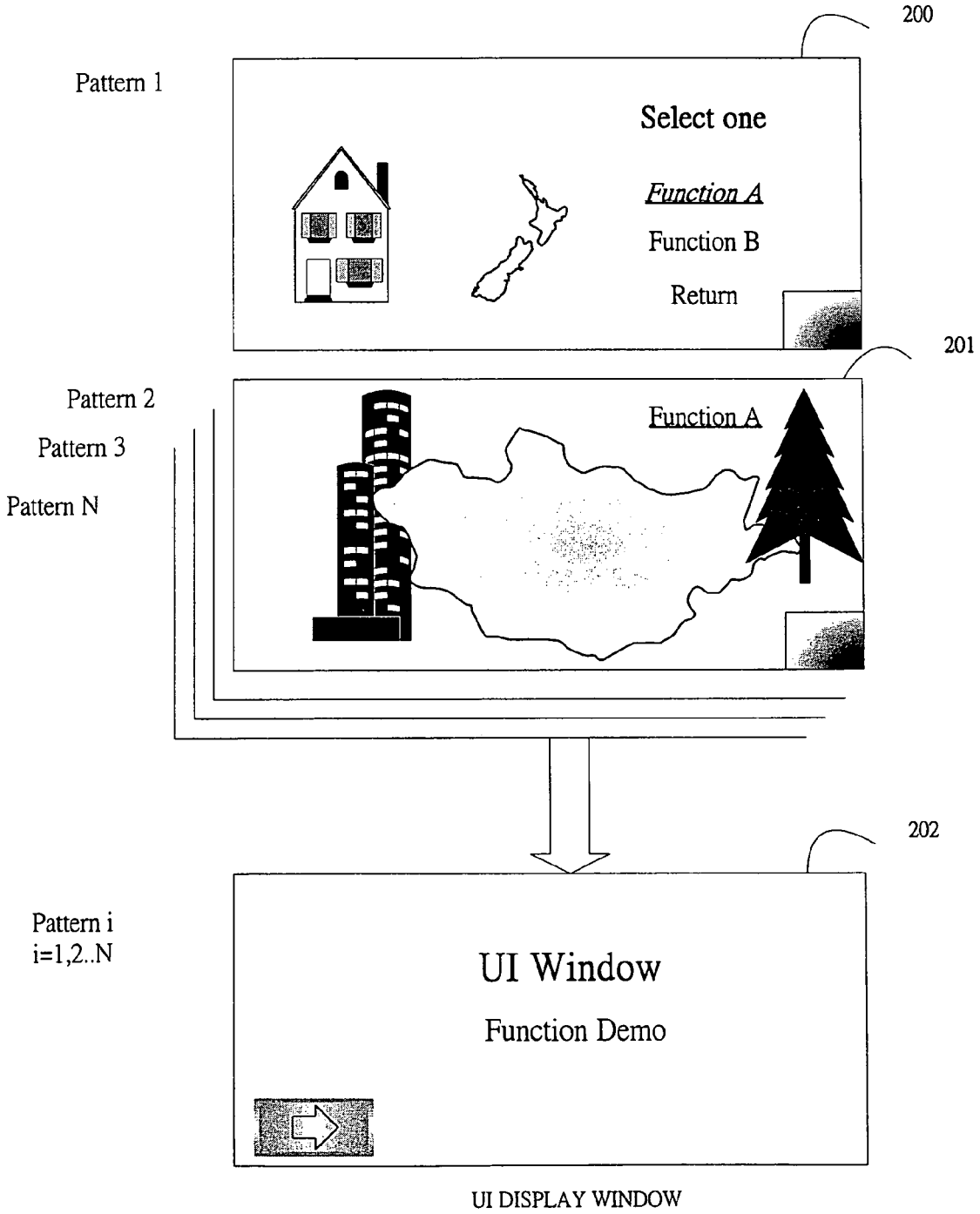
FIG. 2 is an example diagram showing the bitmap method according to the prior art.
Figure 3:
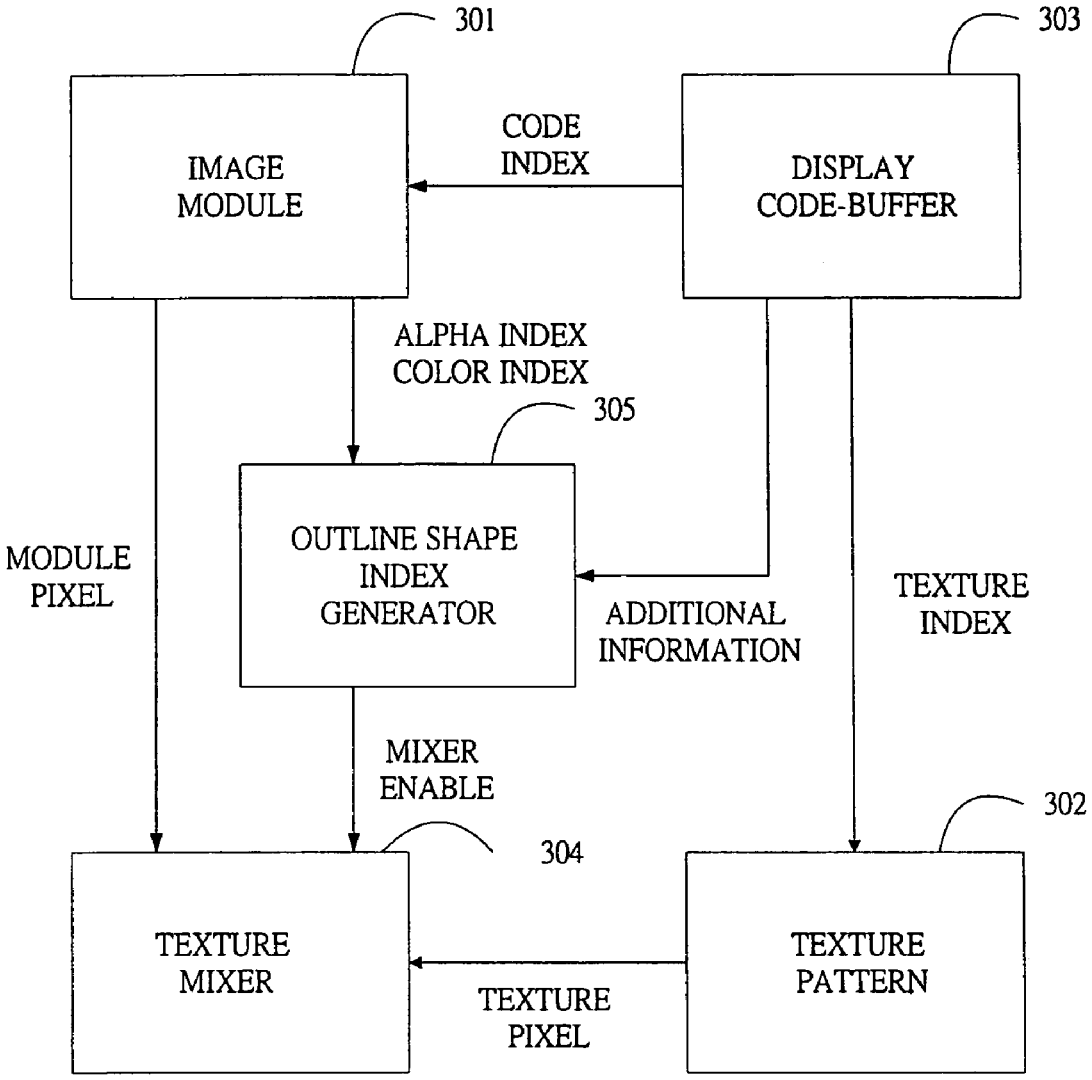
FIG. 3 is a functional block diagram of a user interface display apparatus according to the present invention.

Refer to FIG. 3, where shows the function diagram of a user interface (UI) using texture mapping method according to this present invention. It comprises a image module 301, a texture pattern 302, a display code-buffer 303, a texture mixer 304 and a outline shape index generator 305.

An image module 301 is dealing with a predefined image pattern with size N×M×D, (N, M are the dimension in horizontal and vertical, D is the color depth) it can be large as the UI display range like bitmap method or small as 1 dot. The image module 301 provides the basic display element for UI display window. It may be a character, icon, object or sub-window. The content is pre-defined, and controlled by system maker but not affected by another system. The image module 301 accepts the code index from the display code-buffer 303, and uses the index to generate a image content, then the image pixel is sent to the texture mixer 304, and it also can provide an additional outline shape information generated by alpha index or color index to the outline shape generator 305.

The texture pattern 302 provides a predefined image to fill the mixed area. It accepts the texture index from the display code-buffer 300 and generates the content of texture. Then the texture pixel is sent to texture mixer 304 for mixing. The size and the color depth of predefined texture images are no limitation. It can be the image stored in memory, or generated by pattern generator for some regular patterns like gray bar, color bar, cross talk, gradual color . . . etc.

Display code-buffer 303 is used to arrange the image pasted on the UI display window. It generates the code index for image module 301, texture index for texture pattern 302, and additional information for outline shape generator 305. The sizes of display code buffer 303 will be decided by how many images in image module 301 to differentiate, and how many image patterns can be showed within a UI display window at one time. For example, if we have 256 different kinds of image patterns in image module 301, we need 8-bit codes to differentiate (CW=8), and if the UI window can accept 128 image patterns from image module 301 at one time, we need 128 locations to store the image module contents. That is the display code-buffer 303 will be 128×8 bits for overall UI display window. Moreover, additional attributes (like alpha index, color key, module scaling, flick information . . . ) may be added by module, by line or by window, so some additional bits are need for these attributes in display code-buffer 303.

A texture mixer 304 is used for mixing images from image module 301 and texture pattern 302. The mixing area is defined by the outline shape index generator 305, and the methods will be explained later. The function of texture mixer 304 can be presented as follows:

$$\text{Output (after mixer)}=f(i,j,k)$$

Where i: module pixel; j: outline shape index generator; k: texture pixel.

The mixing method can be overlap, alpha blending or logic operation.

The overlap method is a way just to replace the image of module in mix area by image of texture patterns.

The alpha blending method is using a parameter $\alpha$ with $$\text{Output}=\text{Image of module}\times(\alpha)+\text{Image of texture pattern}\times(1-\alpha)$$

Where the parameter $\alpha$ is a real number between 0 and 1.

The logic operation method is using digital logical operation like AND, OR, XOR, XNOR . . . etc.

$$\text{Output}=(\text{Image of module})\ \text{logic operate with}\ (\text{Image of texture pattern}).$$

Outline shape index generator 305 generates the mixing area information for texture mixer 304. The mixing area information defines the outline shape of module 301 and can be defined by alpha index of modules, the color key method, the sub-window define method, and the pixel index of texture patterns.

Figure 4:
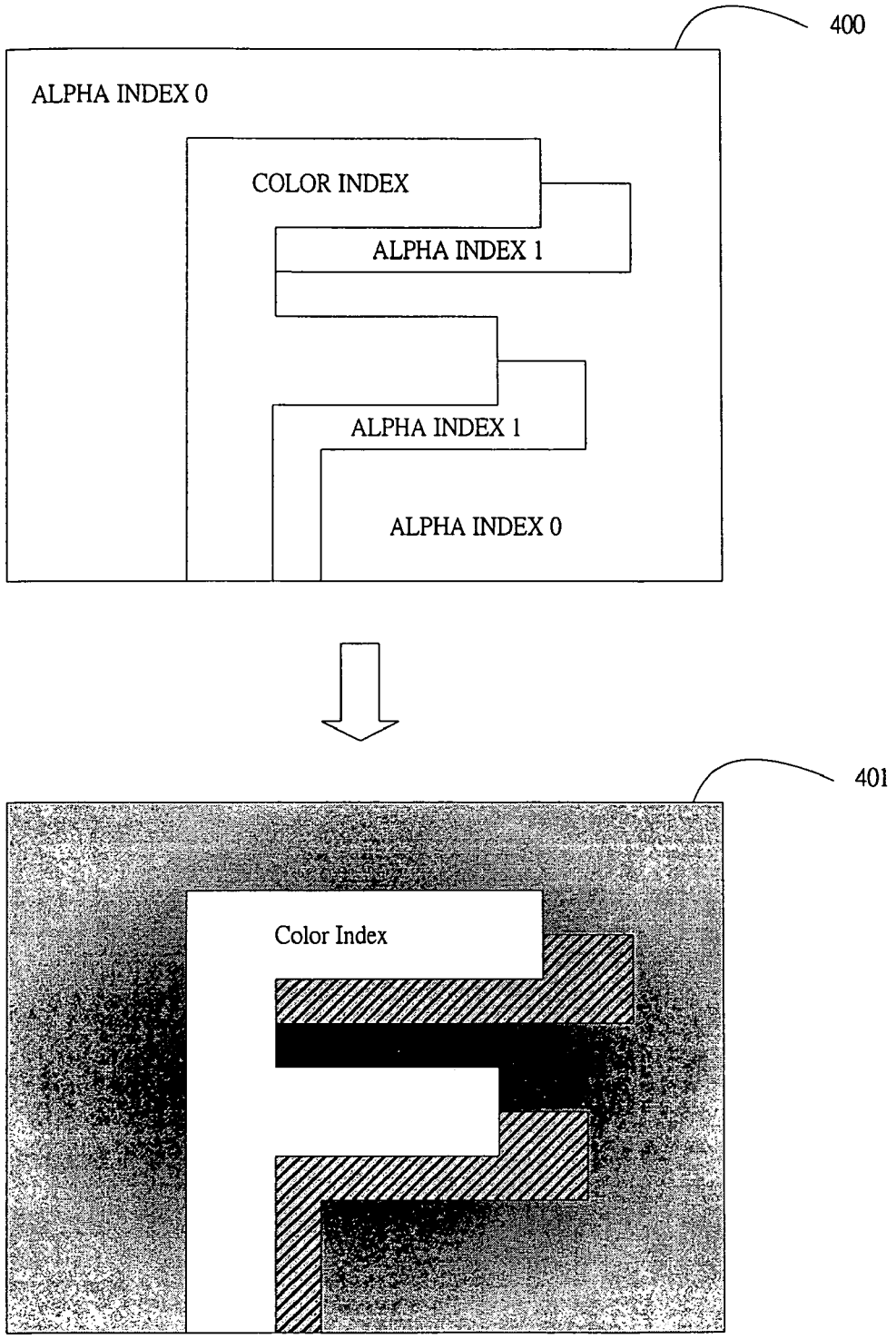
FIG. 4 is an example showing the alpha index method to define the mixed area according to the present invention.

FIG. 4 is an example shows the method using alpha index of modules of the present invention. Alpha index means the defined index mixed with texture pattern, and the others are the color index for color information. The content of module 400 is divided into color index, alpha index 0 and alpha index 1. Alpha Index 0 means the area mixed with texture pattern 0, alpha Index 1 means the area mixed with texture pattern 1, while the color index means the area filled with the original module. The mixed weighting a between module in alpha index area and the texture pattern, and even what kinds of texture patterns are selected by texture mixer 401. The alpha index can be defined by module, by line or by area that depends on the cost. Note that, alpha index can be defined multiple in a module 400. For example, if 0×F, 0×8 both denote the alpha index, 2 kinds of texture patterns can mix in code area of 0×F and 0×8.

Figure 5:
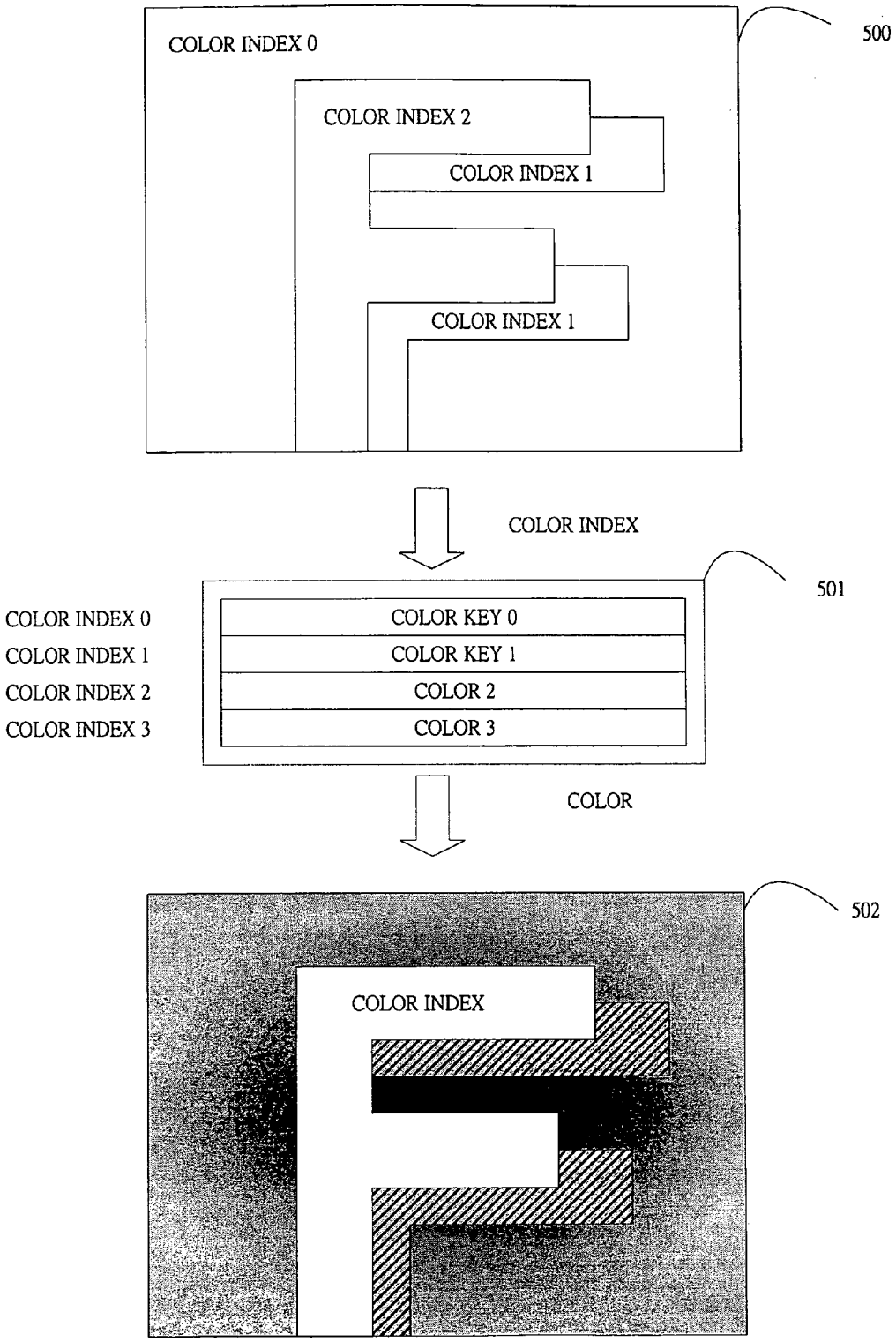
FIG. 5 is an example showing the color key method to define the mixed area according to the present invention.

FIG. 5 is an example shows the color key method of present invention. Since the color depth is typically not enough to get true color which is 8 bits for R, G, B channel, color look up table (palette) 501 may be needed for target display device. Module 500 in different area can be mapped to different palette or color keys. If the index in module mapped to color keys, it will be mixed with the texture pattern. For example, the content of module 500 is divided to color index 0, color index 1 and color index 2. After the color lookup table 501, color Index 0 gets color key 0, color index 1 gets color key 1, and color index 2 gets color 2. The area of color key 0 will mix with texture pattern 0, color key 1 will mix with texture pattern 1, while the color 2 means the area will fill with color 2 of palette. The mixed weighting $\alpha$ between module in color keys area and the texture pattern, and what kinds of texture patterns are selected for texture mixer 502, and even the alpha index can be defined by module, by line or by area depend on the cost.

The color key is similar to alpha index in practice, since the alpha index may be the same as the color key before the palette 501. But there is some difference. For alpha index with 4 bits color depth, the sum of the color index for module and alpha index is only 16, but for color key method, the palette can be much larger (ex: 256) and the index of module can be mapped to the whole palette. Therefore, the restriction of alpha index is not exited in color key method. So color key can be used to extend the flexibility of alpha index for UI designer.

Figure 6:
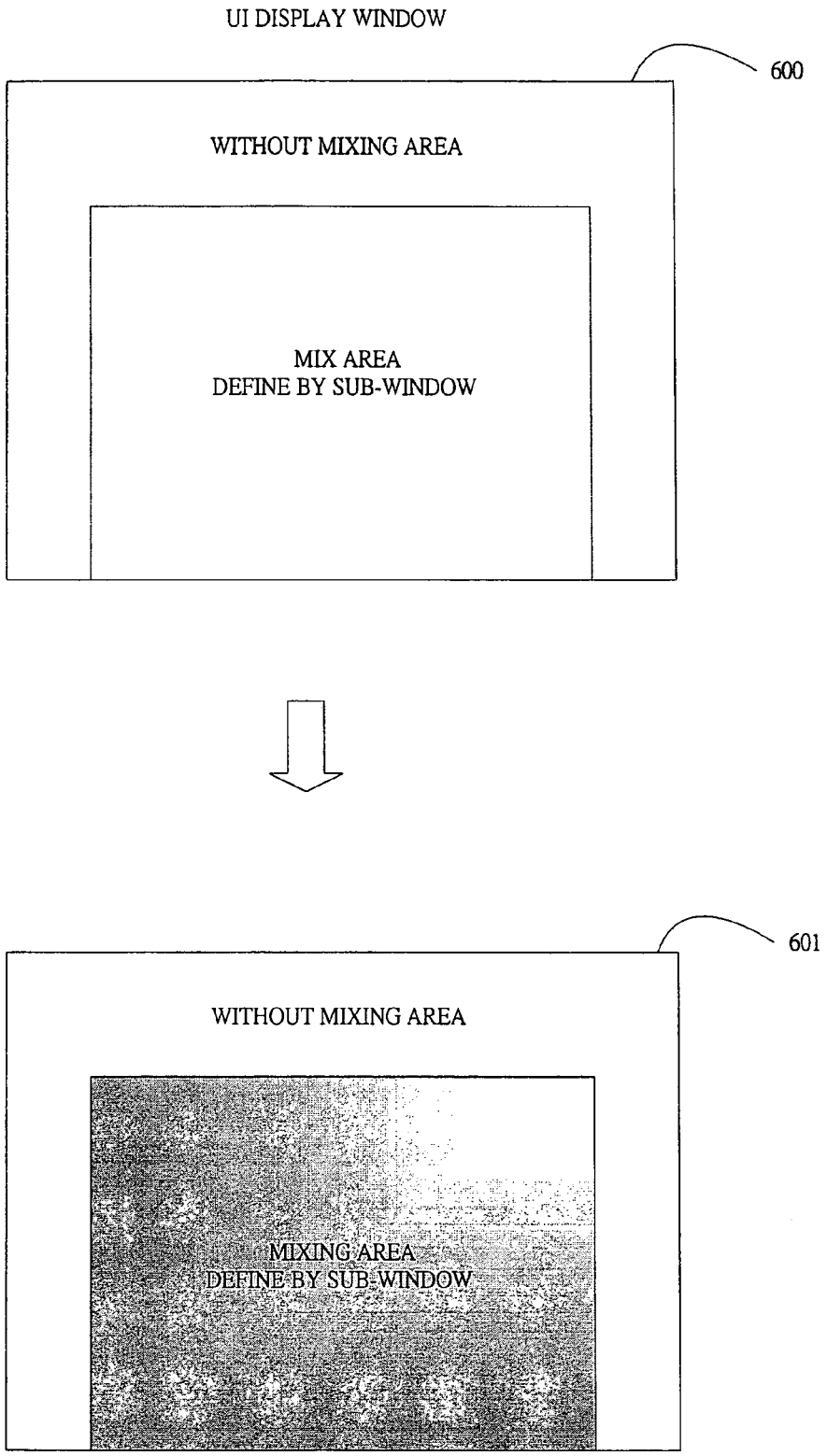
FIG. 6 is an example showing the sub-window method to define the mixed area according to the present invention.

FIG. 6 is an example shows the sub-window defined method of present invention. The UI display window 600 is divided by the parts of "without mixing area", and "mixing area defined by sub-window". We can define a sub-window within the UI display window, and any pixel within the area will mix with the texture pattern. Rectangle shape is easy to define by sub-window, but an irregular shape is difficult.

Figure 7:
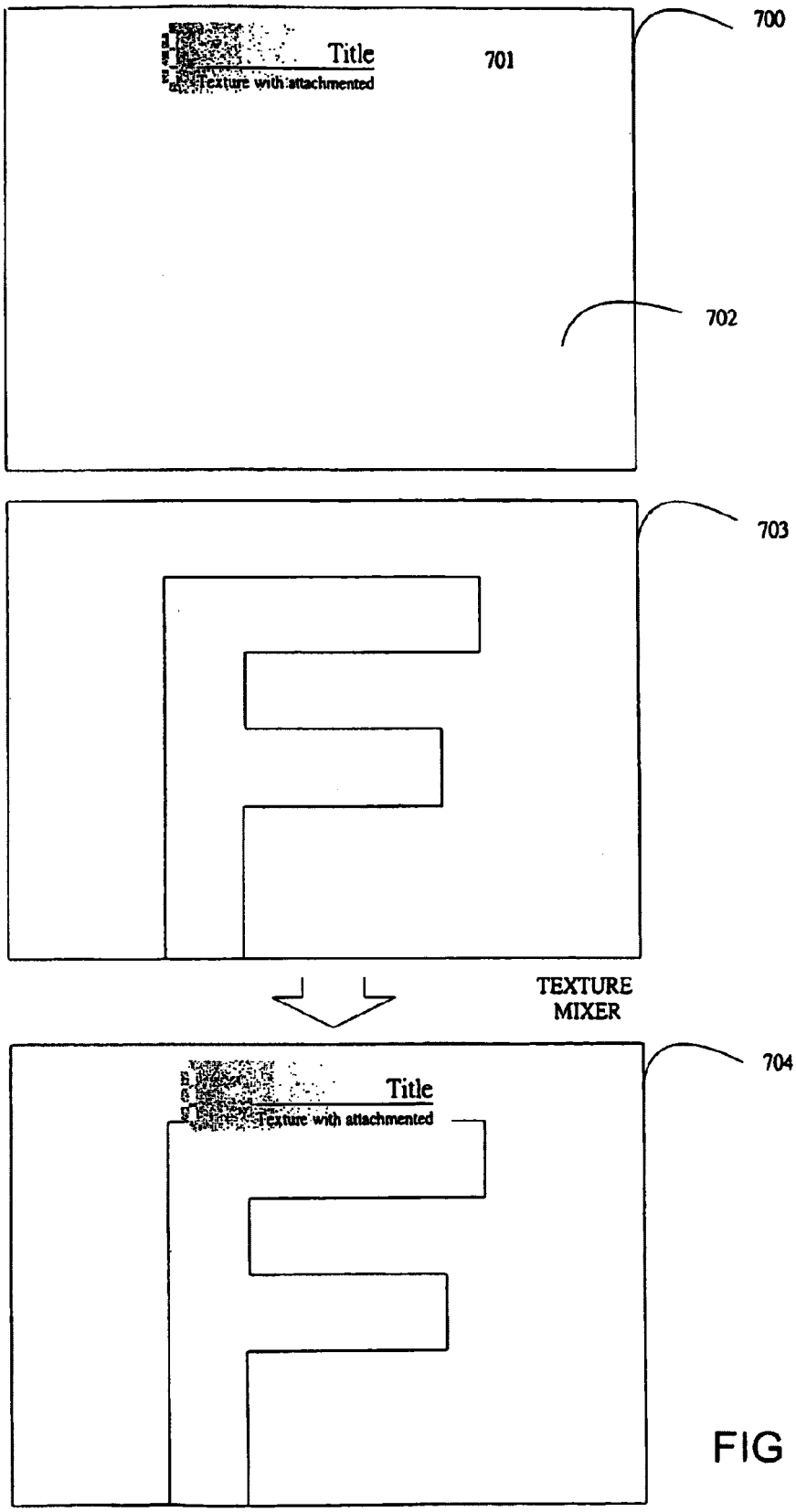
FIG. 7 is an example showing the texture mapping method to define the mixed display image according to the present invention.

FIG. 7 is an example shows the texture patterns index defined method of present invention. The texture pattern is divided into "without mixing area" 702, and "mixing area" 701. The mixed weighting $\alpha$ between module 703 and the texture pattern 700 is defined for texture mixer. Using the method, an irregular shape is very easy to define and attach as display result 704.

Figure 8:
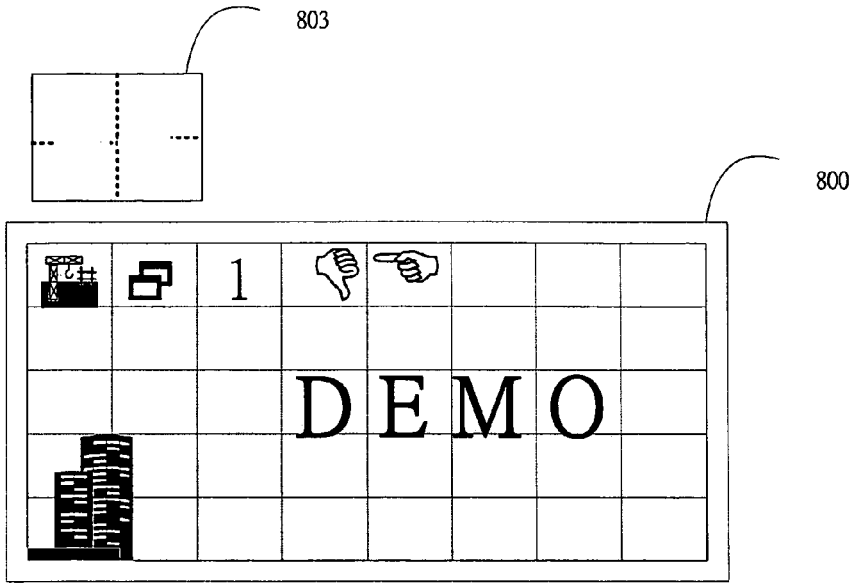
FIG. 8 is an example of user interface display using one texture pattern according to the texture mapping method of the present invention.

FIG. 8 is an example shows the result of using the texture pattern 803 to texture-map the UI display. The texture pattern 803 is used repeatedly within the whole UI display window 800. The other images on the UI display window 800 are the image modules, or objects composed by modules.

Figure 9:
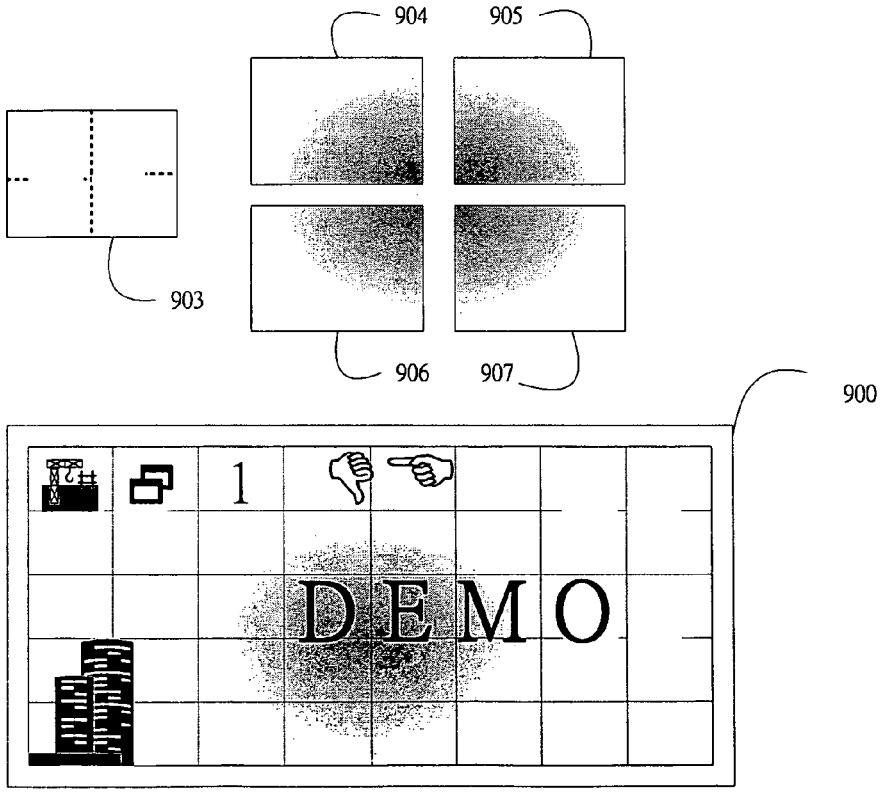
FIG. 9 is an example of user interface display using several texture patterns according to the texture mapping method of the present invention.

FIG. 9 is an example shows the result of using the texture pattern 903, 904, 905, 906, and 907 to texture-map the UI display. The other images on the UI display window 900 are the images from image module, or objects composed by image modules. With the different texture pattern, the UI display 900 in FIG. 9 is different with UI display 800 in FIG. 8. Thus it is easy to change the UI display looking by just change some texture patterns. This feature is also important for end-user who likes to change the UI display looking by himself. The system maker can support the download capacity in system, and then the end-users can download their own image to the texture patterns instead of that made by system makers.

Figure 10A:
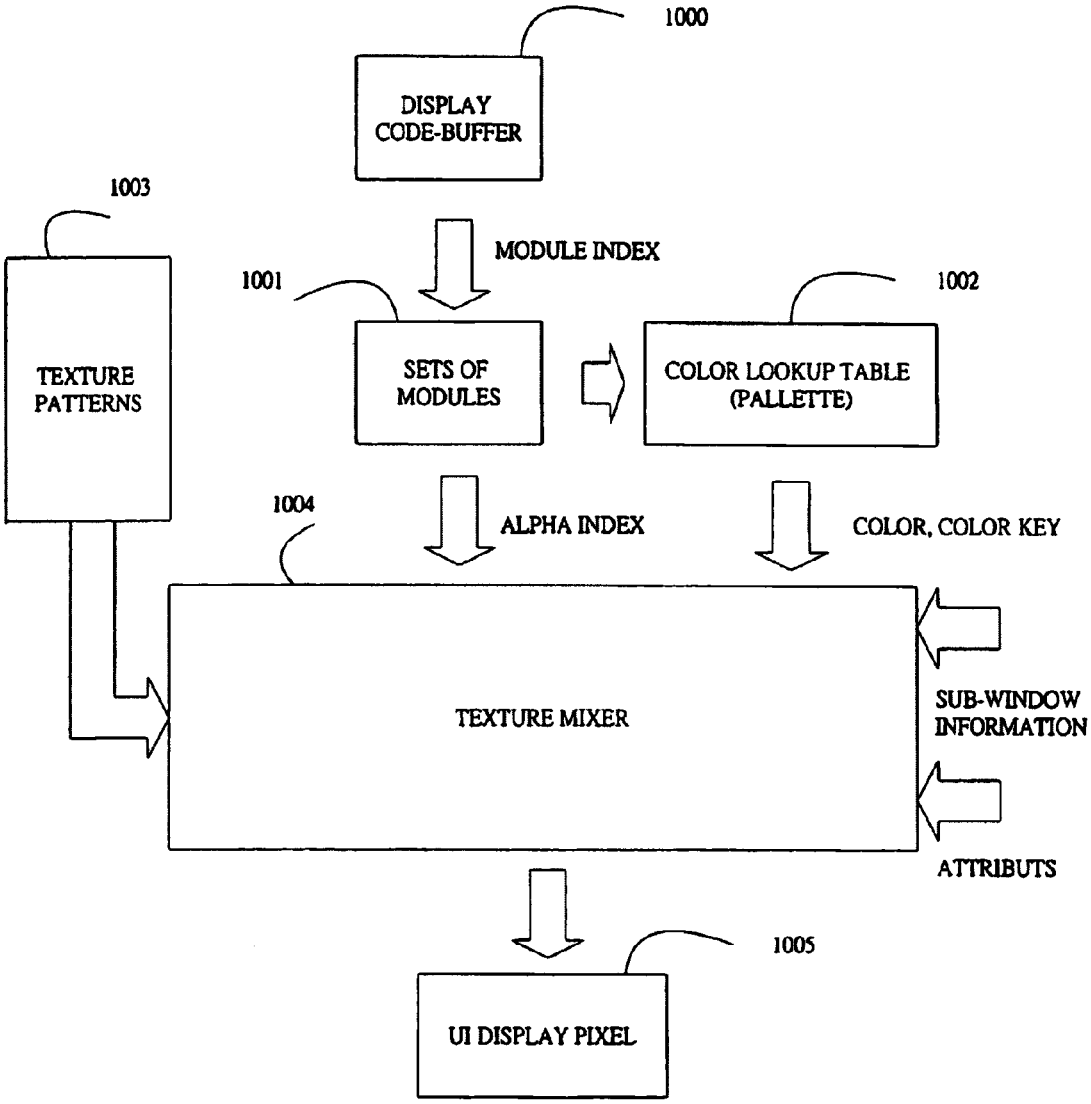
FIG. 10*a*, 10*b* each shows a signal flow block diagram of a user interface display apparatus according to the present invention.
Figure 10B:
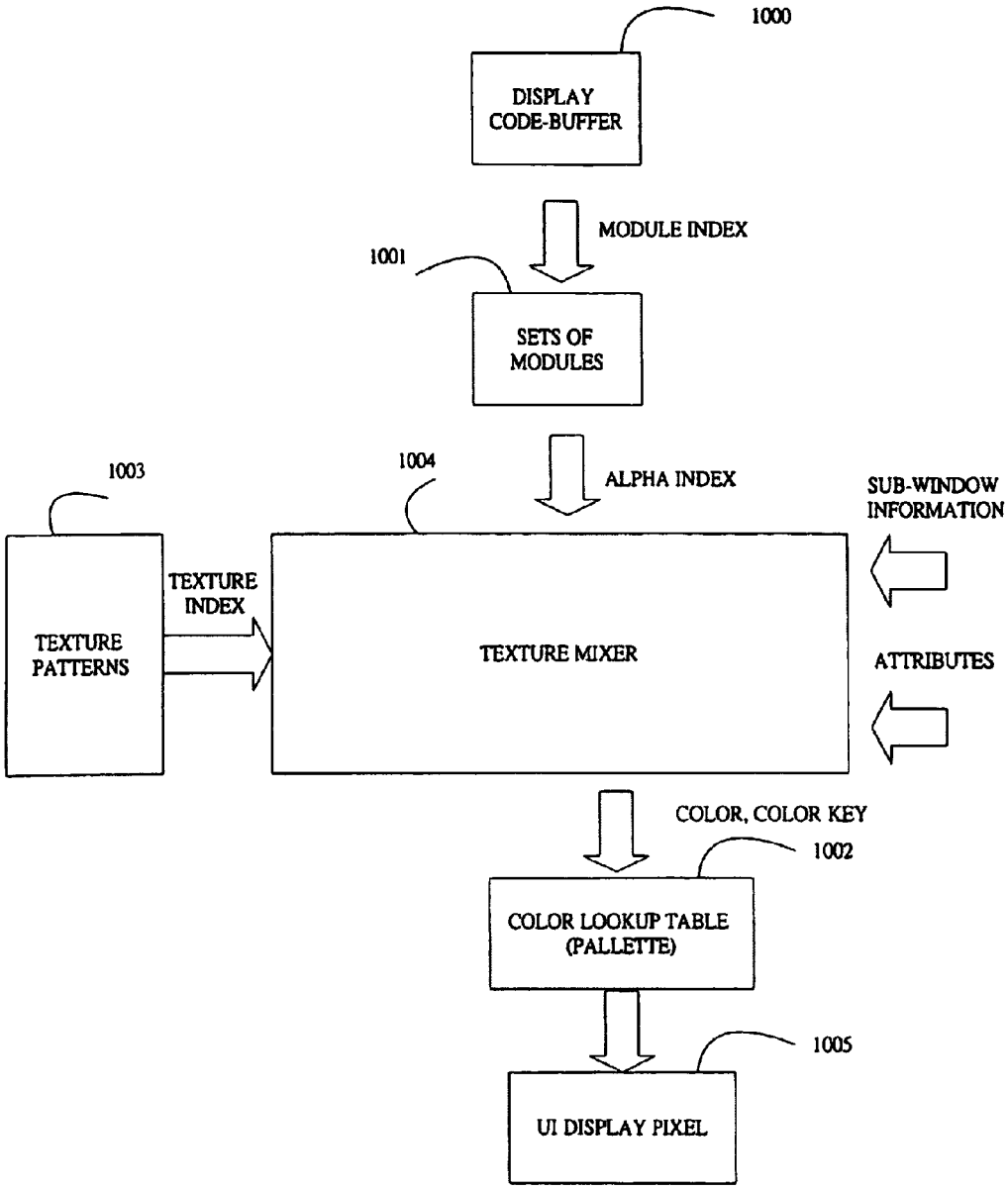

FIG. 10*a* shows the flow diagram of the implementation of a UI display system using texture-mapping method according to the present invention. The display code-buffer 1000 stored the module index, and arranges the location of module, content of UI to display. The sets of modules 1001 are the memory banks of modules, which stored the module content. The content may be font, icon or image. The color lookup table 1002 is a color transfer block for target display. It's generally named palette in many applications and it can be performed by another way as show in FIG. 10*b*. It accepts the input index, and transfers the index to a pre-defined color. The sets of texture patterns 1003 are the pre-defined patterns, like image, or regular patterns generated by some pattern generator like gray bar, gradual color, color bar . . . etc. The mixer 1004 is used for mixing the module content and texture content. The mixing information is alpha index from sets of modules 1000, color index from color lookup table 1001, the sub-window information from the sub-window definition, or index from texture patterns. Other inputs are the weighting of mixing, function of mixing, or some attributes defined by the UI designer. The UI display pixel 1005 is the final result and shown in UI display window for end-user.

Figure 11:
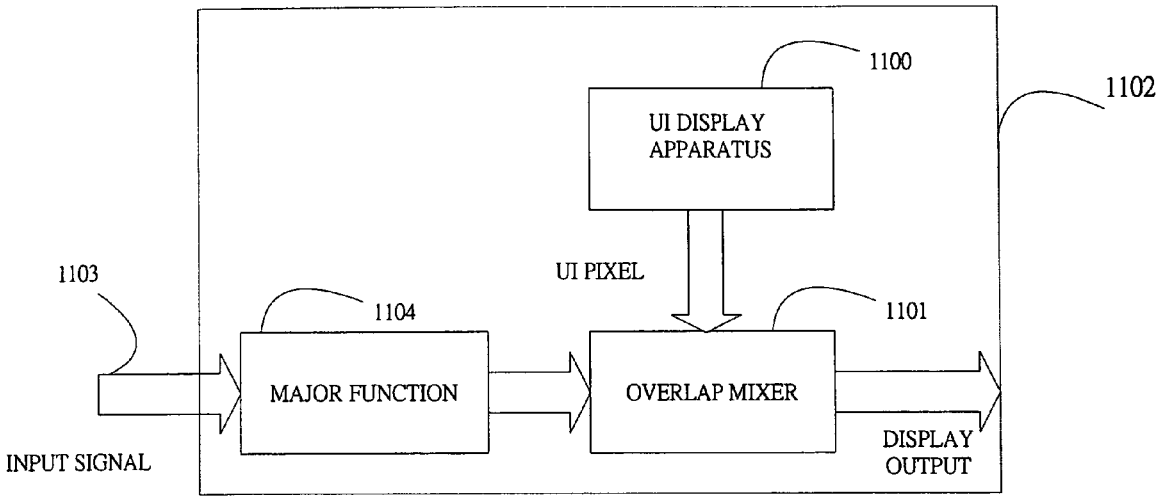
FIG. 11 is a function diagram of a display device embedded a user interface display apparatus.

FIG. 11 is a function diagram shows a typical display device. The UI display apparatus 1101 is a sub-system of a display device 1103. The major function 1104 of display device accepts input signal 1103, the input signal comes from VCR, TV, PC, or computer signal, said input signal enter into the major function 1104 and processing therein, like scaling, filtering of DSP processor. With an overlap mixer 1101, the processed signal is mixed with the UI signal, then output the mixed result to the display. The said display device 1102 is a system like TV, video player, projector, or monitor applications with an OSD sub-system.

Figure 12:
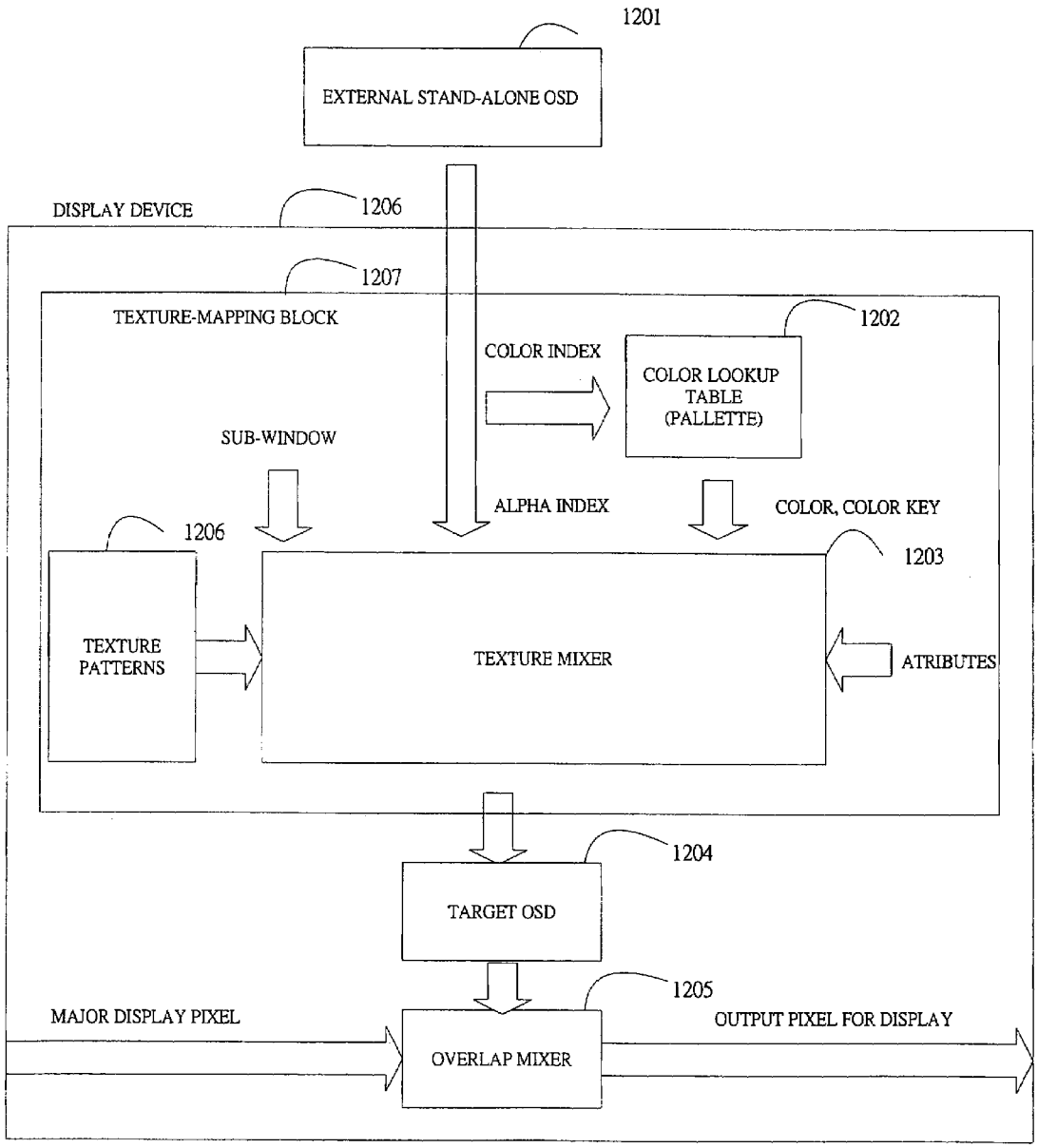
FIG. 12 is a function diagram showing how to enhance a UI display in accordance with the present invention.

FIG. 12 is a method using the present invention to fancy UI display for existing device. Some display device integrate the OSD, they can be re-designed easily to use texture-mapping method. But some display device uses an external stand-alone OSD 1201 (or caption) product due to pin counts limitation, these kinds of OSD have limited and monotone colors (typically, with each R, G, B 1 bit or 2 bits). The external stand-alone OSD 1201 uses character base method to generate OSD data. But in display device, we can use the texture-mapping block 1207, with the alpha index from external OSD 1201, color key from color lookup table 1202, sub-window method, or texture pattern index to define the mixed area for incoming external OSD. For example, we can use RGB=111 as the alpha index for mixing. The texture mixer 1203 gets alpha index from external stand-alone OSD 1201, color or color key from color lookup table 1202, texture pixel from texture patterns 1206, plus sub-window information and the weighting of mixing, function of mixing, or some attributes defined by the UI designer, then the UI display pixel 1204 is generated, and texture mapped. The UI result then mixed by overlap mixer 1205 with the major display pixels from the processed of input signal likes TV, video, computer, and send to display.

This invention is a low cost solution and can be implemented in the UI applications of TV, video Player, projector, and monitor, or display panel of telephone, consumer household appliances, electronic dictionary, calculator . . . ) or to display the message for user to watch (electronic caption, clock, watch, bulletin board, pager . . . ) with a colorful and fancy user interface.

The present invention a UI display system using texture-mapping method is a low cost and easy way for system maker to design a fancy, colorful and user-friendly interface for end-user to operate the system. It is easy to change the content of UI display by changing texture patterns and even the end-user can download their favor image or photo to replace the texture patterns made by system makers if system supports it. Also, the present invention can coexist with the existing OSD devices. With texture-mapping method, even the most monotonous OSD can be changed to a fancy, colorful and user-friendly one.

The above-described embodiments of the present invention are intended to be illustrative only. Numerous alternative embodiments may be devised by those skilled in the art without departing from the scope of the following claims.

What is claimed is:

1. A user interface display apparatus, comprising:

an image module unit for providing image patterns;

a texture pattern unit for providing texture patterns;

a display code-buffer unit for arranging pattern codes which are associated with the image patterns and texture patterns to be displayed on a user interface display window; and a mixer unit for mixing the image patterns and the texture patterns, and output a mixed signal;

wherein the mixer unit uses an alpha blending method, where output=(pattern from said image module unit)×alpha+(pattern from said texture pattern unit)×(1−alpha), and wherein the parameter alpha is a real number between 0 and 1.

2. The user interface display apparatus of claim 1, further comprising an outline shape index generator for providing the mixing index information to define the outline shape.

3. The user interface display apparatus of claim 2, wherein the outline shape index generator further comprising sub-window define function.

4. The user interface display apparatus of claim 2, wherein the outline shape index generator further using alpha index for image pattern.

5. The user interface display apparatus of claim 2, wherein the outline shape index generator further using color key method for image pattern.

6. The user interface display apparatus of claim 1, wherein the predefined image pattern could be any combination of dot pixel.

7. The user interface display apparatus of claim 1, wherein the texture patterns can be defined by end-user.

8. A user interface display apparatus, combined with an traditional on screen display and overlap the output signal, comprising:

an image module unit for providing image patterns;

a texture pattern unit for providing texture patterns;

a display code-buffer unit for arranging pattern codes which are associated with the image patterns and texture patterns to be displayed on a user interface display window; and a mixer unit for mixing the image patterns and the texture patterns, and output a mixed signal;

wherein the mixer unit uses an alpha blending method, where output=(pattern from said image module unit)×alpha+(pattern from said texture pattern unit)×(1−alpha), and wherein the parameter alpha is a real number between 0 and 1.

9. The user interface display apparatus of claim 8, further comprising an outline shape index generator for providing the mixing index information to define the outline shape.

* * * * *